United States Patent [19]

Cook

[11] Patent Number: 4,964,091

[45] Date of Patent: Oct. 16, 1990

[54] ELECTROACOUSTIC TRANSDUCER

[75] Inventor: Rufus L. Cook, Panama City, Fla.

[73] Assignee: The United States of America as represented by the Secretary of the Navy, Washington, D.C.

[21] Appl. No.: 78,284

[22] Filed: Oct. 5, 1970

[51] Int. Cl.[5] ..... H04R 1/02

[52] U.S. Cl. ..... 367/165; 367/167; 310/346

[58] Field of Search ..... 340/8, 9, 10; 310/8.2, 310/340, 346, 347; 367/155, 158, 159, 165, 167

[56] References Cited

U.S. PATENT DOCUMENTS

| | | | |
|---|---|---|---|
| 2,438,926 | 4/1948 | Mott | 340/11 |
| 2,638,577 | 5/1953 | Harris | 340/10 |
| 2,760,181 | 8/1956 | Camp | 340/10 |
| 3,068,446 | 12/1962 | Ehrlich et al. | 340/8 R |
| 3,090,939 | 5/1963 | Massa | 340/10 X |
| 3,136,380 | 6/1964 | McCoy et al. | 340/8 R X |
| 3,370,186 | 2/1968 | Antonevich | 340/10 X |
| 3,418,624 | 12/1968 | Massa | 340/10 X |

*Primary Examiner*—Charles T. Jordan
*Assistant Examiner*—Stephen Johnson
*Attorney, Agent, or Firm*—Sol Sheinbein; John Becker; Harvey David

[57] ABSTRACT

This invention pertains to the electroacoustic transducer arts and discloses an improved physical construction therefor in which a honeycomb-like member is used to secure both pressure release and thermal transfer for the converting element.

24 Claims, 2 Drawing Sheets

ELECTROACOUSTIC TRANSDUCER

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

In the field of acoustical engineering, the design parameters of pressure release and thermal stability have heretofore been opposing factors which have required mutual compromise in constructing electroacoustic transducers. That is, pressure release is obtained by surrounding the faces of the electroacoustic element with gaseous or solid material having low compressional energy transfer ability. Such material generally has very low thermal transfer ability and permits heat build up in the element. Heat, as well understood, has deleterious effects on the efficiency, frequency response, and operational life of the electroacoustic transducer element.

Attempts to cool the element so as to prevent the thermal build-up have resulted in mass loaded heat sinks, oil or other insulating cooling material encapsulation, and other well understood techniques. These arrangements have undesirably modified the free space resonance characteristics of the electroacoustic conversion elements in direct relation to their cooling effectiveness. As a result, the completed transducers of the prior art seldom approached the theoretical performance of the transducer element.

SUMMARY OF THE INVENTION

The instant invention utilizes a honeycomb-like structural preform placed about the faces of the transducer from which acoustic radiations are unwanted. This material may be advantageously made of lightweight metal, such as aluminum, so as to effectively transfer heat to the surroundings without excessive mass loading of the transducer element. The precise nature of this material and the fashion in which it cooperates with the electroacoustic element will be more completely described herein.

It is, accordingly, an object of this invention to provide an improved electroacoustic transducer.

A further object of this invention is the provision of an electroacoustic transducer having enhanced temperature and pressure characteristics.

A further object of this invention is the provision of a means to conduct heat from non-radiating faces of piezoelectric acoustic transponders.

A further object of this invention is the provision of an electroacoustic transducer assembly having radiation conversion characteristics closely approaching the theoretical design characteristics of the transducer element.

A further object of this invention is the provision of an electroacoustic transducer having improved structural strength to withstand the pressures placed thereon by deep submergence.

A still further object of the instant invention is to provide an improved electroacoustic transducer of low cost.

Yet another object of this invention is the provision of a piezoelectric acoustic transducer with predictable energy transmission patterns that is relatively simple to construct.

Yet another object of the instant invention is the provision of an improved backing element for electroacoustic transducers.

Another object of this invention is to provide a piezoelectric acoustic transducer having an open honeycomb pressure release element fashioned of lightweight metal.

Other objects and many of the attendant advantages will be readily appreciated as the subject invention becomes better understood by reference to the following detailed description, when considered in conjunction with the accompanying drawings.

DESCRIPTION OF THE PREFERRED EMBODIMENT

Figure 1:
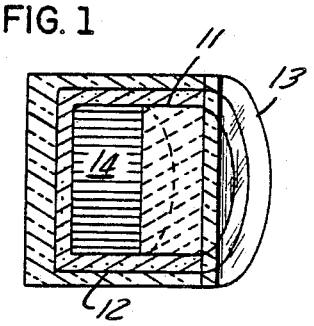
FIG. 1 is a sectional view of a transducer according to the invention.

Referring to FIG. 1, a piezoelectric element 11 is shown mounted within a pressure release shell 12. Pressure release shell 12 may be made of conventional construction material, such as balsa wood, for example. Likewise the piezoelectric element 11 may be made of any suitable material, but, for purposes of discussion, lead zirconate, rochelle salt, or barium titanate may be considered the preferred embodiment. The entire pressure release shell 12, including piezoelectric element 11 contained therein, is encapsulated in a potting compound, such as "Scotchcast", to form an acoustically transparent housing 13.

For purposes of clarity of illustration, the electrical conductors to piezoelectric element 11, and other piezoelectric elements shown herein, have been omitted.

Thus far, the constructional elements recited are conventional, however, it will be observed that piezoelectric element 11 is backed with a cellular honeycomb element 14. Honeycomb element 14 is held in place by pressure release shell 12 and transparent housing 13 although, if desired, high strength cements may be used to bond piezoelectric element 11 thereto.

Figure 2:
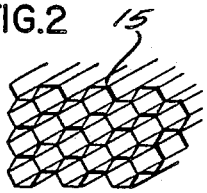
FIG. 2 is a perspective view of a section of the honeycomb element used in the invention.

FIG. 2 shows a section of honeycomb stock 15 from which honeycomb element 14 is made. This material is available in a variety of thicknesses and compositions. Aluminum honeycomb is commonly available, and, because of its high strength-to-weight properties, is preferred in the devices of the invention. Honeycomb stock 15 is fabricated from strips suitably formed in to corrugations and bonded together. The bonding technique varies depending on design choice of the constructor and both the adhesively bonded and the weld bonded types may be used in the practice of the invention. The stock 15 may be deformed slightly in the plane at right angles to the axis of the hexagonal cells so as to permit forming it to the desired shape, but still retain great strength along the axis of the cells.

The word "honeycomb" is attributable to a variety of constructions. However, as used in this application, the word refers only to the hexagonal celled preform, such as illustrated in FIG. 2. It has been found that this particular structure when combined with a piezoelectric element in the particular fashion described herein results in a greatly improved electroacoustic transducer.

Figure 3:
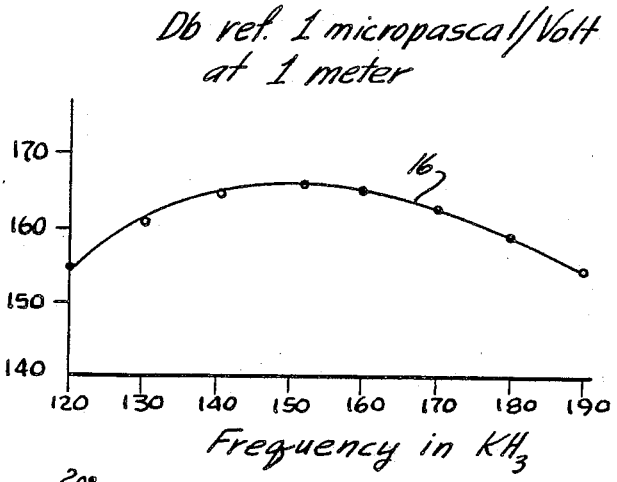
FIG. 3 is a graphic representation of the output of the transducer of FIG. 1 as a function of frequency.

As shown in FIG. 3, the power frequency curve 16, obtained from a transducer of the construction of FIG. 1, corresponds to the ideal curve for such units. The broad frequency curve without abrupt changes is a result of the elimination of resonances and oscillatory contributions of the mounting arrangement.

Figure 4:
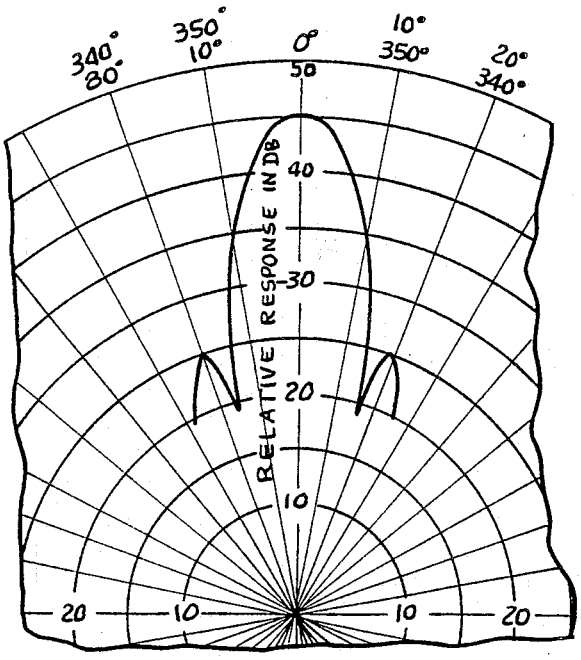
FIG. 4 is a graphic representation of the transducer of FIG. 1 as a function of angular displacement from the axis thereof.

FIG. 4 shows the improved directional response attributable to a transducer according to the invention and made as illustrated in FIG. 1. The elongated on-axis curve and small symmetrical side lobes indicate that the back radiations from piezoelectric element 11 have been largely eliminated by the novel construction illustrated.

The simplified construction discussed above is not the only configuration made possible by the invention. The invention has made it possible to construct a variety of electroacoustic transducers using the honeycomb material with its cells filled with a suitable gas, air for example, as a pressure release structure in addition to its use as a thermal transfer element for conducting heat to a suitable heat sink to thereby prevent heat build-up in the associated piezoelectric elements.

This improved dual function of a light, high strength pressure release component that additionally permits rapid thermal transfer may fairly be said to characterize the invention. Applicant is aware that transducer elements of the prior art devices have been hexagonally shaped for a variety of purposes. Further, hexagonal honeycomb-like members are known as acoustic energy transfer members or loading members as shown by Antonevich in U.S. Pat. No. 3,370,186 for Ultrasonic Transducers issued Feb. 20, 1968. However, a transducer with honeycomb material, as herein defined, employed as a thermal conducting, non-resonant, pressure release material is believed to be unknown in the prior art. This simple construction permits smaller, less expensive transducers to be made for use in higher power applications and deeper ocean depths than with similarly priced or sized components of the prior art.

In the species of the invention illustrated in FIG. 1, the honeycomb material is used in conjunction with conventional pressure release material. However, maximum benefit of the new material may be more fully realized if it is used instead of the conventional material. How this improved construction may be obtained will become more apparent in light of the examples now to be described.

Figure 5:
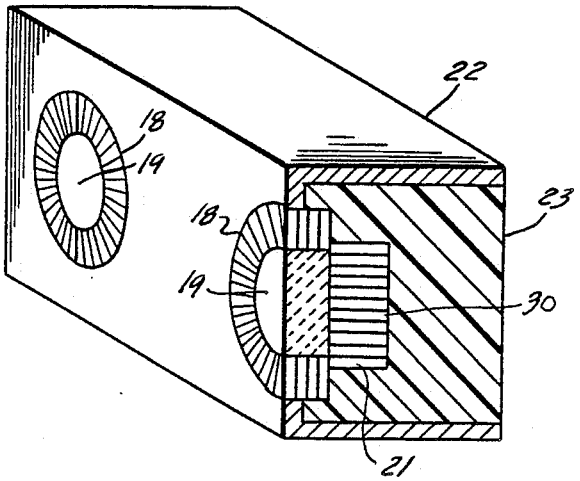
FIG. 5 is a perspective view, partially in section, of an embodiment of the invention.

Referring to FIG. 5, honeycomb collar 18 surrounds a cylindrical piezoelectric element 19. The cells of collar 18 extend radially outward from piezoelectric element 19. This configuration may be readily achieved by bending a strip of honeycomb stock 15. In such a forming operation, the individual cells deform slightly but not sufficiently to weaken their compressional strength. The rear face of piezoelectric element is covered with a honeycomb backing 21. As shown, a plurality of the units may be supported in a common housing 22 which is then filled with suitable potting material 23. The individual units, so mounted, may be wired so as to form an array as is well understood in the electroacoustical arts.

Potting material 23 may be regarded as a heat sink dissipating more heat than could honeycomb collar 18 and honeycomb backing 21 unassisted. In addition, the potting material 23 seals the ends of the cells of honeycomb collar 18 and backing 21 to confine a fluid 30, such as oil, air, or other suitable gas therein. It is this entrapped fluid, oil air or other gas which provides the acoustic pressure relief.

Figure 6:
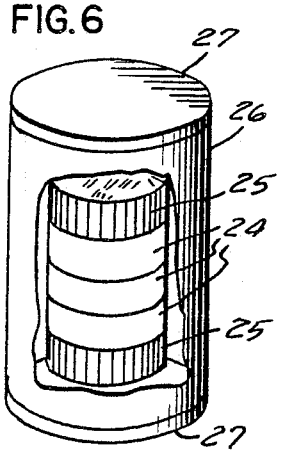
FIG. 6 is a perspective view in partial cutaway of another embodiment of the device of the invention.

FIG. 6 shows how the concepts of the invention may be applied to another transducer construction. A plurality of cylindrical piezoelectric elements 24 are stacked into a cylindrical column. Honeycomb elements 25 are placed at the head and foot of the column with the longitudinal axes of the cells thereof in alignment therewith so as to provide pressure relief in the longitudinal direction. Piezoelectric elements 24 together with honeycomb elements 25 comprise an electroacoustic assembly which is mounted within the enclosure of acoustically transparent wall portion 26 and end portions 27 of a cylindrical housing. The remainder of the space within the cylindrical housing may be filled with suitable potting material, if desired.

In the foregoing transducer constructions, the mechanical arrangement have been secured with potting material. A variety of such materials are commercially available and are known to those versed in the transducer arts. When fluid, this material is somewhat tacky and viscous, and does not fill the air spaces of the cells of the honeycomb material. Should other material having more fluid characteristics be used as a heat sink or surround, it becomes necessary to cap or seal off the open of the cells to produce the desired pressure release characteristics. A thin sheet of plastic or metal may be used to good effect for this purpose by placing it across the open cells of the honeycomb material. This permits the honeycomb construction technique to be used in electroacoustic transducers having liquid in direct contact with the electroacoustic assembly.

One particular area, then, where the transducer construction of the invention is useful is in the composite, high-power type transducer. These transducers commonly use oil to cool the piezoelectric elements so as to prevent the build up of excessive heat therein.

Figure 7:
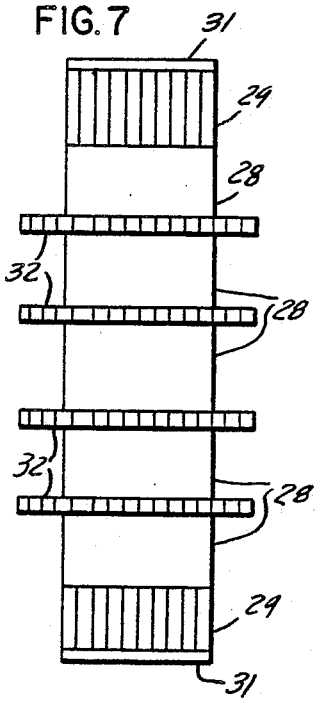
FIG. 7 is an elevation view of a stacked linear array of transducer elements according to the invention.
Figure 8:
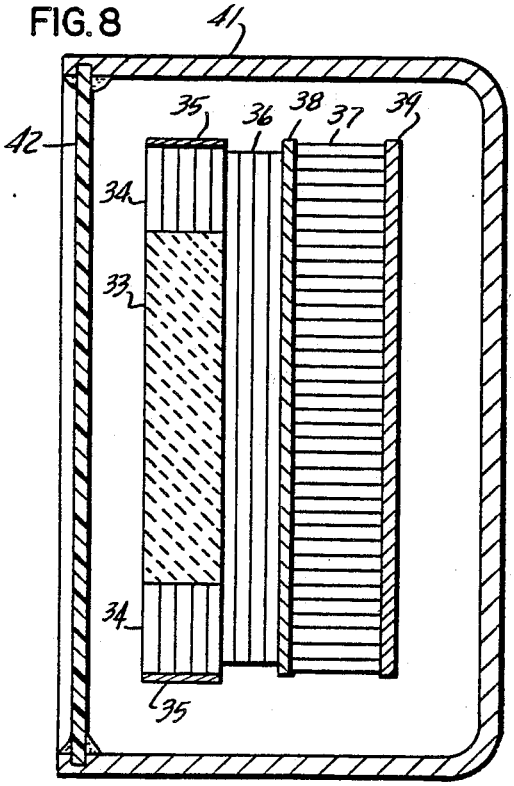
FIG. 8 is a sectional view of an oil cooled embodiment of the invention using the honeycomb elements of the invention to provide static pressure compensating relief therefor.

FIG. 7 shows a transducer according to the invention which is particularly suited for use in an oil immersion construction. A plurality of piezoelectric elements 28 are stacked to form a column, as before. Honeycomb end elements 29 are attached to the head and the foot of the column in axial alignment therewith. Honeycomb end elements 29 have their outer ends closed with an end cap 31. End cap 31 may be made of the same material as honeycomb end elements 29, and may be bonded thereto by cement or other technique which will insure total closure in the high temperature oil environment. Intermediate adjacent ones of piezoelectric elements 28, honeycomb discs 32 are placed. Honeycomb discs 32 are bonded to the contiguous piezoelectric elements 28, and provide pressure release therebetween. Because the honeycomb collars are much less than a wavelength thick, they have no discernible effect on the resonance of the assembly. The portions of honeycomb discs 32 extending beyond piezoelectric elements 28 are open at the top and bottom and permit the surrounding oil to circulate through the cells thereof to effect a greater surface area to be exposed to the flowing oil than would otherwise be possible. Honeycomb elements 29 could be extended to have the same lateral dimensions as discs 32, if desired, however, the arrangement shown is preferred and provides somewhat more even heat distribution FIG. 8 shows how the general element configuration of FIG. 5 may be adapted for oil immersion applications. Cylindrical piezoelectric element 33 is surrounded on its curved sides by a honeycomb collar 34. Gas retention in the cells of collar 34 is made possible by bonding a sealing wall 35 about its outer circumference.

A heat transfer member 36 is bonded to the rear of piezoelectric element 32 and collar 34. Any suitable bonding technique may be employed for this purpose. As shown, heat transfer member 36 is made of honeycomb cellular material with the cells open to permit oil circulation therethrough. Making heat transfer member 36 of honeycomb stock 15 permits the piezoelectric element 33 to exhibit more freedom of pressure equalization movement. This has been found to be a highly desirable property for transducers carried to great ocean depths where pressures are excessive for other configurations. Pressure release is provided across the back face by honeycomb element 37 which is sealed by walls 38 and 39. Housing 41 and acoustic window 42 provides an oil tight enclosure for the structure.

If the transducer is not to be subjected to high static pressures, heat transfer member 36 and wall 38 may be omitted to place honeycomb element 37 in contact with crystal 33. In such an alternative construction honeycomb element 37 may still extend to the edge of collar 35 and have wall 39 smaller, so as to expose the peripheral cells to coolant oil. The extended uncovered peripheral cells function similar to those in discs 32, FIG. 7, to enhance the heat transfer therefrom.

MODE OF OPERATION

The device of the invention is used in the same manner as the devices of the prior art insofar as the specific applications are concerned. For this reason no specific description is deemed necessary as to how the device may be incorporated in sonar, underwater communication systems, or other electroacoustical systems.

The details of the operation of the system is similarly straightforward. The piezoelectric elements of the invention are acoustically coupled to the environment in predetermined desired areas or directions and shielded from the environment by the pressure release properties attributable to the cellular nature of the honeycomb in other areas or directions. Despite the excellent pressure release properties associated with the structure, the invention permits greatly improved heat transfer from the piezoelectric element outwardly therefrom.

The foregoing description taken together with the appended claims constitute a disclosure such as to enable a person skilled in the electroacoustical transducer arts and having the benefit of the teachings contained therein to make and use the invention. Further, the structure herein described meets the objects of invention, and generally constitutes a meritorious advance in the art unobvious to such a skilled worker not having the benefit of the teachings contained herein.

Obviously, other embodiments and modifications of the subject invention will readily come to the mind of one skilled in the art having the benefit of the teachings presented in the foregoing description and the drawings. It is, therefore, to be understood that this invention is not to be limited thereto and that said modifications and embodiments are intended to be included within the scope of the appended claims.

What is claimed is:

1. An electracoustic transducer having improved pressure and temperature characteristics, comprising in combination:

piezoelectric means having a cylindrical shape for providing conversion between electrical and acoustical energies;

a pressure release collar, having a plurality of hexagonal-shaped honeycomb-like cells, extending around and in contact with the curved surface of said cylindrically shaped piezoelectric means for effecting the acoustically isolating thereof;

a gas filling the plurality of hexagonal-shaped honeycomb-like cells of said pressure release collar for providing acoustic pressure release for the curved surface of said cylindrically shaped piezoelectric means;

heat sink means disposed in thermal contact with said pressure release collar for absorbing heat conducted thereto thereby; and housing means effectively surrounding predetermined portions of said piezoelectric means, said pressure release collar, and said heat sink means for effecting the support thereof in predetermined relative spatial orientations, respectively.

2. The invention of claim 1, further characterized by a backing means having another plurality of hexagonal-shaped honeycomb-like cells, with the axes thereof parallel to the cylindrical axis of said piezoelectric means and, with one end thereof connected to one of the ends of said piezoelectric means for effecting a predetermined pressure release thereof.

3. A transducer, comprising in combination:

an energy converter means having a predetermined geometrical configuration;

a pressure release collar, having a plurality of honeycomb-like cells, extending around and in contact with a predetermined peripheral surface of said energy converter means;

resilient means disposed within the plurality of honeycomb-like cells of said pressure release collar for effecting a predetermined pressure release of the aforesaid predetermined peripheral surface of said energy converter means; and means effectively surrounding predetermined portions of and effectively connected to the aforesaid energy converter means, pressure release collar, and resilient means for effecting the support thereof in a predetermined geometrical configuration.

4. The invention of claim 3, further characterized by heat sink means disposed in thermal contact with the plurality of honeycomb-like cells of said pressure release collar for conducting heat away therefrom.

5. The invention of claim 4, wherein said heat sink means disposed in thermal contact with the plurality of honeycomb-like cells of said pressure release collar for conducting heat away therefrom comprises a predetermined potting material.

6. The transducer of claim 3, wherein said energy converter means having a predetermined geometrical configuration comprises a piezoelectric cylinder.

7. The transducer of claim 3 wherein said energy converter means having a predetermined geometrical configuration comprises a lead zirconate cylinder.

8. The transducer of claim 3, wherein said energy converter means having a predetermined geometrical configuration comprises a barium titanate cylinder.

9. The transducer of claim 3, wherein the plurality of honeycomb-like cells of said pressure release collar comprises a plurality of aluminum honeycomb-like cells.

10. The transducer of claim 3, wherein the plurality of honeycomb-like cells of said pressure release collar for effecting a predetermined pressure release of the aforesaid predetermined peripheral surface of said energy converter means comprises a plurality of heat conducting metallic honeycomb-like cells.

11. The transducer of claim 3, wherein said resilient means disposed within the plurality of honeycomb-like cells of said pressure release collar for effecting a predetermined pressure release of the aforesaid predetermined peripheral surface of said energy converter means comprises a predetermined gas.

12. The transducer of claim 3, wherein said resilient means disposed within the plurality of honeycomb-like cells of said pressure release collar for effecting a predetermined pressure release of the aforesaid predetermined peripheral surface of said energy converter means comprises air.

13. The transducer of claim 3, wherein said resilient means disposed within the plurality of honeycomb-like cells of said pressure release collar for effecting a predetermined pressure release of the aforesaid predetermined peripheral surface of said energy converter means comprises a predetermined oil.

14. The transducer of claim 3, wherein said resilient means disposed within the plurality of honeycomb-like cells of said pressure release collar for effecting a predetermined pressure release of the aforesaid predetermined peripheral surface of said energy converter means comprises a predetermined fluid.

15. The invention of claim 3, further characterized by a pressure release backing means, having another plurality of honeycomb-like cells, connected to another surface of said energy converter means for effecting a predetermined pressure release thereof.

16. The invention of claim 15, further characterized by resilient means disposed within the plurality of honeycomb-like cells of said pressure release backing means for effecting a predetermined pressure release of the aforesaid another surface of said energy converter means.

17. The invention of claim 16, wherein said resilient means disposed within the plurality of honeycomb-like cells of said pressure release backing means for effecting a predetermined pressure release of the aforesaid another surface of said energy converter means comprises a predetermined gas.

18. The invention of claim 16, wherein said resilient means disposed within the plurality of honeycomb-like cells of said pressure release backing means for effecting a predetermined pressure release of the aforesaid another surface of said energy converter means comprises air.

19. The invention of claim 16, wherein said resilient means disposed within the plurality of honeycomb-like cells of said pressure release backing means for effecting a predetermined pressure release of the aforesaid another surface of said energy converter means comprises a predetermined oil.

20. The invention of claim 16, wherein said resilient means disposed within the plurality of honeycomb-like cells of said pressure release backing means for effecting a predetermined pressure release of the aforesaid another surface of said energy converter means comprises a predetermined fluid.

21. The invention of claim 16, wherein the plurality of honeycomblike cells of said pressure release backing means comprises a plurality of heat conducting metallic honeycomb-like cells.

22. The invention of claim 16, wherein the plurality of honeycomblike cells of said pressure release backing means comprises a plurality of aluminum honeycomb-like cells.

23. The invention of claim 16, further characterized by heat sink means disposed in thermo contact with said pressure release backing means for conducting heat therefrom.

24. The invention of claim 23, wherein said heat sink means disposed in contact with said pressure release backing means for conducting heat therefrom comprises a predetermined potting material.

* * * * *